United States Patent [19]

Nemoto et al.

[11] Patent Number: 4,963,940

[45] Date of Patent: Oct. 16, 1990

[54] TONER CARTRIDGE FOR A COPYING APPARATUS

[75] Inventors: Mitsugu Nemoto; Atsuo Ohmura; Jun-ichi Koiso; Kohji Ishii, all of Hachioji, Japan

[73] Assignee: Konica Corporation, Tokyo, Japan

[21] Appl. No.: 382,728

[22] Filed: Jul. 19, 1989

[30] Foreign Application Priority Data

Jul. 22, 1988 [JP] Japan ..... 63-182857

[51] Int. Cl.[5] ..... G03G 15/06; G03G 21/00

[52] U.S. Cl. ..... 355/260; 355/298; 222/DIG. 1

[58] Field of Search ..... 355/260, 298; 206/316.1; 222/DIG. 1

[56] References Cited

FOREIGN PATENT DOCUMENTS 3223275 1/1983 Fed. Rep. of Germany .
0146171 11/1981 Japan .
0184373 10/1984 Japan ..... 355/298
2089689 6/1982 United Kingdom .

*Primary Examiner*—A. T. Grimley
*Assistant Examiner*—Nestor R. Ramirez
*Attorney, Agent, or Firm*—Jordan B. Bierman

[57] ABSTRACT

A toner cartridge for supplying a toner to a photo-copy machine and collecting a waste portion of the toner after a copy operation with the photo-copy machine, comprising; a cylindrical body for providing a supplement toner containing room and a waste toner collecting room by means of a separating wall inside, the separating wall for dividing the supplement toner containing room and the waste toner collecting room, an outlet being located on the wall of the cylindrical body at the side of the supplement toner containing room for supplying the toner contained in the room into the photo-copy machine, and an inlet being located on the wall of the cylindrical body at the side of the waste toner collecting room for collecting the waste portion of the toner from the photo-copy machine, in which the separating wall is angled so that its surface is leaned toward the supplement toner containing room or the waste toner collecting room.

3 Claims, 5 Drawing Sheets

TONER CARTRIDGE FOR A COPYING APPARATUS

BACKGROUND OF THE INVENTION

This invention relates to a toner cartridge used for a developing device in which an electrostatic image is formed on a photoreceptor drum by an electrophotographic recording system or an electrostatic recording system.

Generally speaking, an image recording device in which an electrostatic image is utilized for copying an image, such as an electrophotographic copier or an electrostatic recording device, forms an electrostatic image on a photoreceptor, makes the image visible with toner by a developing device, transfers the toner image to a recording paper, and fuses it to obtain a recorded image. After the image on the photoreceptor drum has been transferred to a recording paper, residual electric charge on the drum is eliminated by a neutralizing electrode and residual toner on the drum is removed by a cleaning unit.

In the developing device mentioned above, about 70 percent of the toner supplied from a toner container is used for developing and the remaining 30 percent is removed from the drum by the cleaning unit and collected in a collecting container. If the toner supplying container and the toner collecting container are separately installed, a large-sized developing device is needed, and in addition, when the toner supplying container is replaced, an operator sometimes forgets to replace the toner collecting container as he is not aware that it is full of collected toner. In this case, the collected toner overflows the container and soils the surroundings.

As a countermeasure against this, a one body type container which consists of a toner supplying container and a collected toner container, separated by a partition board, is conventionally used. For instance, refer to Japanese Patent Publication Open to Public Inspection No. 146171/1981.

The conventional toner container shown in FIG. 8, a schematic illustration, has a vertical pratition board 83 to separate the toner supplying container 81 from the collected toner container 82. Because the toner 85, which is poured from the upper opening 84 mounted on the top of the collected toner container 82, gradually piles up from the bottom to the top, a space 86 is formed which cannot be completely filled by the toner 85. Accordingly, the amount of toner held in the collected toner container fluctuates, and sometimes the toner overflows from the container before the periodic container replacement time comes.

An object of this invention is to solve the problems explained above. In other words, it is an object of the invention to provide a toner cartridge of a copier in which the amount of collected toner in a toner container is stabilized.

SUMMARY OF THE INVENTION

In order to attain the object, in a toner cartridge of a copier which comprising a toner supplying container and a collected toner container, both connected with each other through a partition board, the above-mentioned partition board in the toner cartridge is inclined so that a space which cannot be filled, can not be created in the cartridge.

BRIEF DESCRIPTION OF THE DRAWINGS

The drawings show one of the examples of the present invention.

DETAILED DESCRIPTION OF THE INVENTION

Figure 1:
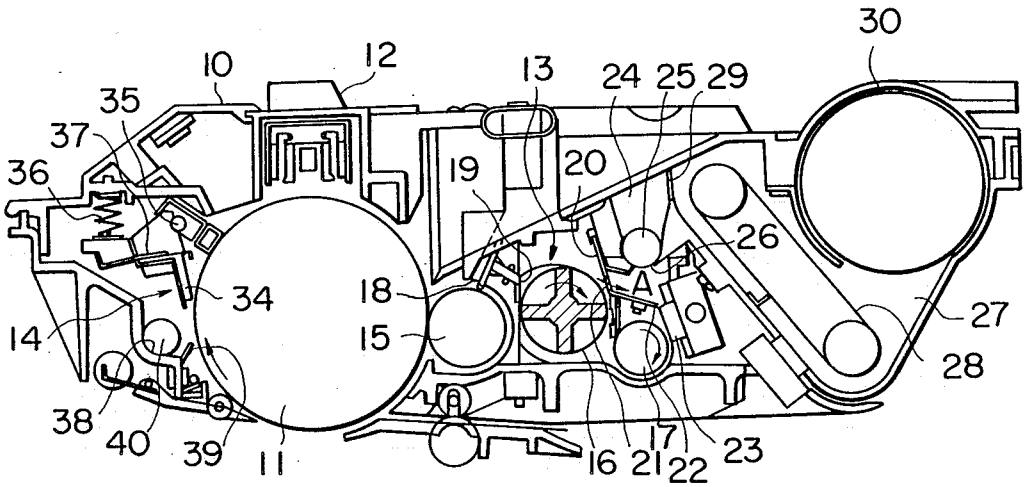
FIG. 1 is an enlarged sectional view of a process cartridge into which the cartridge of the invention is built.

Referring now to the drawings FIG. 1 to FIG. 7, an example of the present invention will be explained.

In the drawing, the numeral 10 is a process unit of the copier. In the process unit 10, there are installed the photoreceptor drum 11, the electrification unit 12 around the drum, the developing unit 13, and the cleaning unit 14. An image transfer unit is installed on the side of the copier corresponding to the downward side of the photoreceptor drum 11, so it is not shown in the drawings.

In the developing unit 13, there are installed the developing sleeve 15, the main stirring member 16, and the auxiliary stirring member 17. A portion of developer which was stirred up by the main stirring member passes through the gap between the doctor 18 and the developing sleeve 15, adheres to the surface of the developing sleeve 15, and is used to develop electrostatic images on the surface of the photoreceptor drum 11. A portion of developer is sent back through the gap between the restricting plate 19 and the main stirring member 16, and circulated to the auxiliary stirring member 17 through the aperture 21 installed in the partition plate 20 as indicated by an arrow mark A. The toner density sensor 23 which detects magnetic permeability is installed in the path of the developer which flows through the above-mentioned aperture 21 in the direction of the arrow mark A. According to the detected value, a signal to drive or to stop is output to the drive unit of the toner supplying roller 25 mounted in the toner supplying chamber 24. When the toner supplying roller 25 starts rotating, the toner in the toner supplying chamber 24 comes down through the gap between the toner supplying roller 25 and the edge member 26 of an aperture groove. The numeral 27 is a toner storing chamber, and the numeral 28 is a ladder chain which supplies toner to the toner supplying chamber 24 from the toner storing chamber 27 through the window 29.

Figure 2:
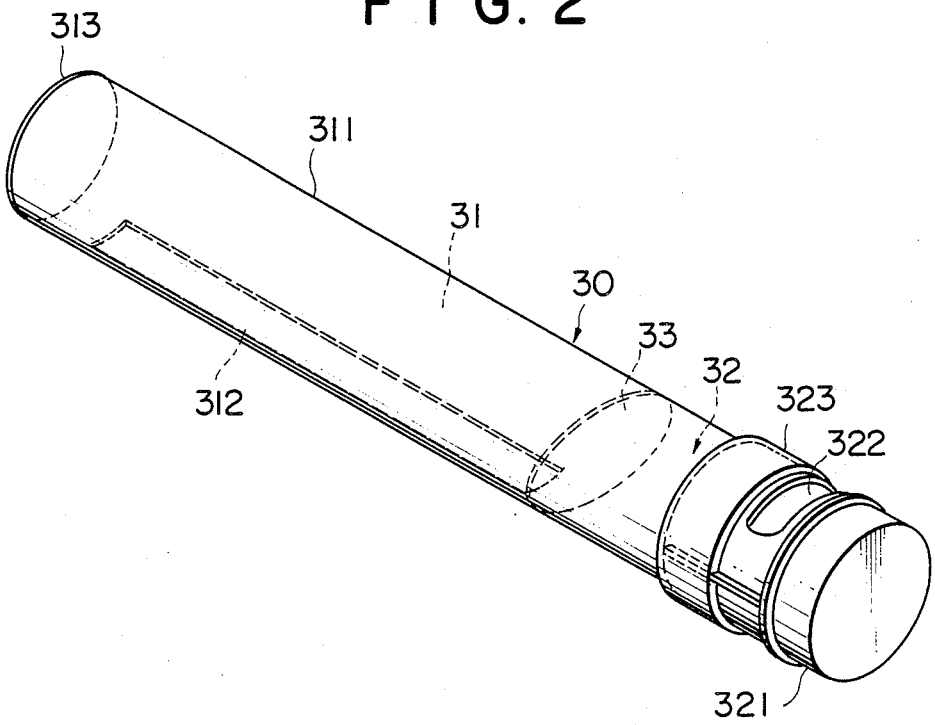
FIG. 2 is a perspective view of a toner cartridge of the invention.
Figure 3:
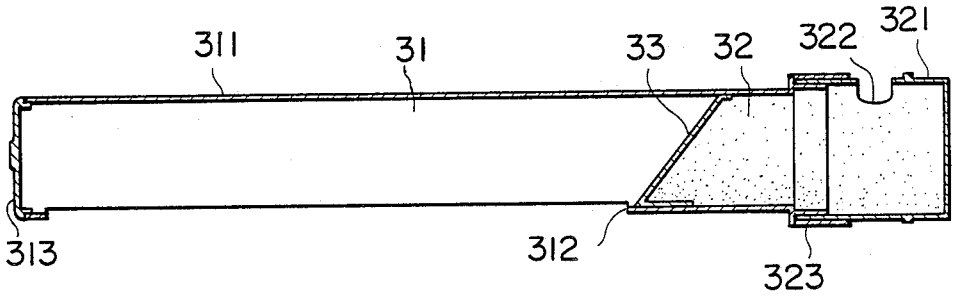
FIG. 3 is a front sectional view of it.
Figure 4:
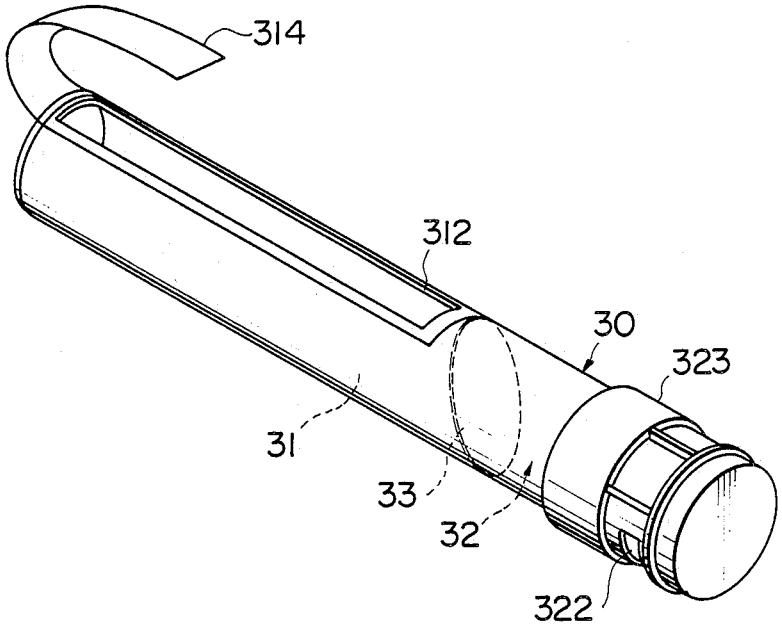
FIG. 4 is a perspective view of a cartridge of the invention wherein a toner supplying opening is in an upper position.
Figure 5:
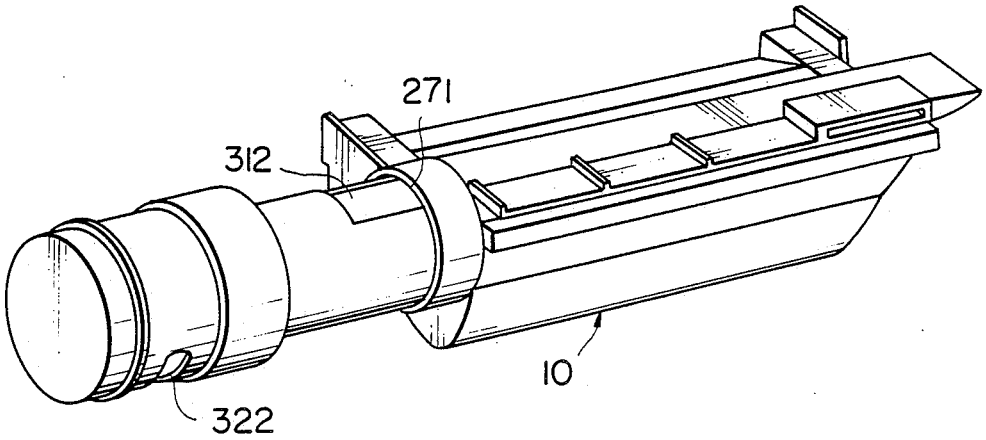
FIG. 5 is a perspective view which shows how a cartridge of the invention is constructed.

The numeral 30 is a toner unit of the invention. As shown in FIG. 2 through FIG. 4, the toner unit 30 is equipped with the supplying toner storing container 31 and the collected toner storing unit 32, wherein both of them are separated by the partition plate 33. The supplying toner storing unit 31 consists of the cylindrical body 311 and an end portion, the left side end in FIG. 2, is kept covered by the cap member 313. The toner supplying aperture 312 is installed on the cylindrical body along the axis. The toner supplying aperture 312 is sealed by the flexible sealing member 314 after toner has been put in the cylindrical body 311. Refer to FIG. 4. In the collected toner storing unit 32, the toner collecting aperture 322 is installed along the circumferential surface of the cylindrical body 321 with the inclined end plate inside, in other words the partition board 33, and the toner collecting aperture 322 is covered by the shutter 323 which can slide in the direction of the axis of the cylindrical body. The position of the toner collecting aperture 322 of the collected toner storing unit 32 is installed on the opposite side of the toner supplying aperture 312 of the supplying toner storing unit 31 with regard to the axis of the cylindrical drum. Therefore, when the toner unit 30 of the present invention is mounted in the mounting unit 271 on the toner storing chamber 27, the toner supplying aperture 312 is set upward as shown in FIG. 5 and the end plate 313 is set on the inner side, in other words the collected toner storing unit 32 is set on the operator's side. After a part of the mounting unit 271 is inserted, an operator holds the tip of the flexible seal and peels it off. The toner unit is pushed in with its toner supplying aperture is fully opened. After that, the operator holds the end of the collected toner storing unit 32 and rotates it by 180° to set the toner supplying aperture 312 downward. Then the toner in the supplying toner storing unit 31 drops into the toner chamber 27 by gravity to supply the chamber with toner. On the other hand, the toner collecting aperture is set upward and it can take in the collected toner.

Figure 6:
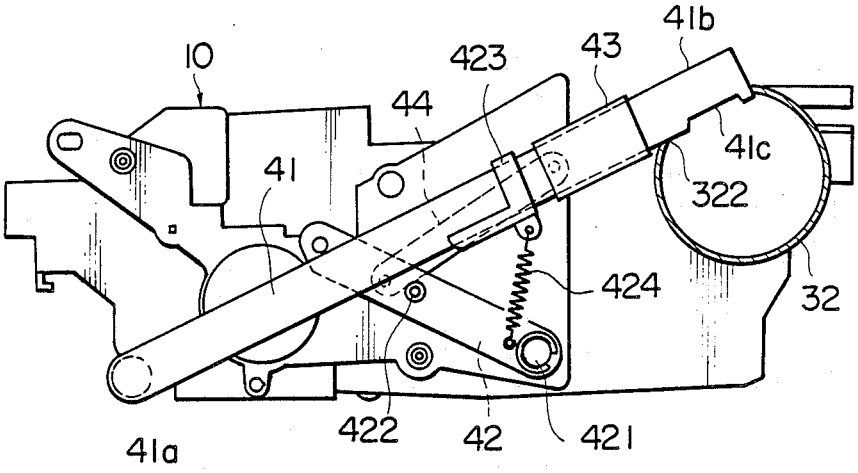
FIG. 6 is a front view of an image forming unit which shows a collected toner conveyance means.

The numeral 34 is a blade which comes into contact with the photoreceptor drum 11 with pressure and scrapes off the residual toner on the drum surface after transfer. The blade 34 is installed at the front edge of the support frame 37 which is given anticlockwise torque by the compression spring 36 with regard to the shaft 35. The numeral 38 is a receiving unit for the collected toner scraped off by the blade 34. The numeral 39 is a toner guide plate. The numeral 40 is a conveyance screw which is installed in the toner receiving unit 38. As shown in FIG. 6, the conveyance screw 40 is installed at a position of the process unit 10 to the toner receiving portion and it is set in the hollow body 41, the base end 41*a* of which rotates and the conveyance screw 40 penetrates the hollow body 41 from 41*a* through 41*b*. The discharge port 41*c* is installed on the lower surface of the tip 41*b* of the hollow body 41 and engages with the toner collecting aperture 322 in the collected toner storing unit 32 of the toner unit 30 of the present invention. Thus, the toner scraped off from the photoreceptor drum 11, is collected by the conveyance screw 40 through the hollow body 41 from the toner receiving unit 38 and conveyed to the toner storing unit 32.

Figure 7:
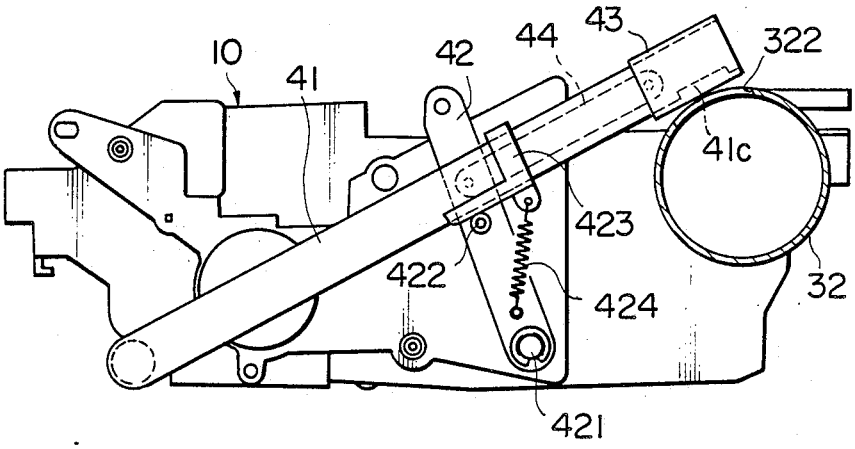
FIG. 7 is a front view of a process cartridge when a toner cartridge of the invention is replaced.
Figure 8:
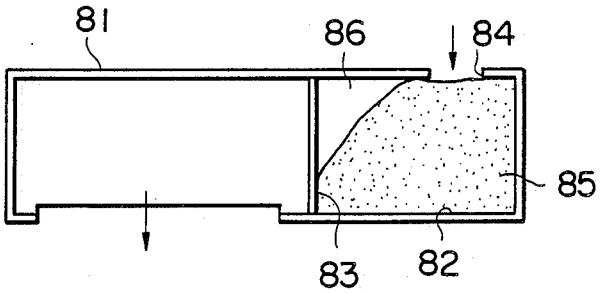
FIG. 8 PRIOR ART
FIG. 8 is a schematic illustration of a conventional toner cartridge.

The numeral 42 is a lever which rotates the hollow body 41 to a position where it does not interfere when the toner unit of the invention 30 is inserted into the apparatus or removed from it. The lever 42 can be raised around the shaft 421 in a clockwise direction. When the lever 42 is raised as shown in FIG. 7, the pin 422 mounted on the lever slides along the lower surface of the frame member 423 which is mounted on the outer surface of the hollow body 41. As a result, the hollow body 41 is rotated upward around the base end 41*a*. The lever 42 is kept standing up due to the coil spring 424 which is between the lever 42 and the frame member 423.

The numeral 43 is a shutter which is installed on the the hollow body 41 to open and shut the discharge port 41*c*. The shutter 43 is connected with the lever 42 through link member 44. Accordingly, when the lever 42 is raised and the hollow body 41 is rotated upward, the discharge port 41*c* is closed. On the other hand, when the lever 42 is brought down as shown in FIG. 6, the discharge port 41*c* is opened.

In the example explained above, when the toner unit 30 of the invention is set at the upper portion of the toner storing chamber 27 of the developing unit 13 in the prescribed way, the toner supplying aperture is fully opened, and when the toner unit is turned downward, the toner in the supplying toner container 31 drops to the toner storing chamber 27 by gravity to supply it. The toner held in the toner storing chamber 27 is gradually conveyed to the toner supplying chamber 24 by the ladder chain 28. A proper quantity of toner is supplied to the developer by the toner supplying roller 25 which is driven according to a signal sent from sensor 23.

On the other hand, the remaining toner on the photoreceptor 11 after images are transferred, is scraped off by the blade 34 and collected to the toner receiving unit 38 through the toner guide plate 39. Then, the collected toner is conveyed by the conveyance screw 40 through the hollow body 41 and returned to the collected toner container 32 from the toner collecting aperture 322.

In this way, the toner collected from the photoreceptor 11, is gradually accumulated in the collected toner container 32. The collected toner fills the spacious bottom space surrounded by the inclined partition board 33. The toner is gradually piled up in the space along the lower surface of the inclined partition board 33 without creating a void space. Consequently, fluctuation of the amount of the collected toner can be effectively prevented.

As mentioned above, the feature of the invention is, in a copier toner unit which consists of a supplying toner container and a collected toner container, that they are both connected with each other through a partition board, and the partition board is inclined. For that reason, a space which toner cannot fill is not formed in the upper part of the partition board, and therefore the invention has an excellent effect on stabilizing the amount of toner held in the collected toner container.

What is claimed is:

1. A toner cartridge for supplying toners to a developer and collecting a waste portion of toner after a copying operation, said cartridge comprising:

a cylindrical body, a separating wall inside said body thereby dividing said body into a supply toner container and a waste toner collector;

an outlet on a curved wall of said body at a side of said supply toner container whereby toner is supplied to said developer through said outlet;

an inlet on said curved wall at the side of said waste toner collector whereby said waste portion of toner is introduced into said waste toner collector through said inlet after said copying operation, said outlet and said inlet are on opposite sides of said curved wall, and said separating wall means is angled so that one length of a first side of said collector on which said inlet is located is shorter than another length of a second side of said collector opposite said first side.

2. The toner cartridge of claim 1 further comprising:

shutter means for controlling outflow of said waste portion of said toner from said waste toner collector, wherein said shutter means is adjacent said inlet and axially movable with relation to said body.

3. The cartridge of claim 1 wherein said separating wall is substantially rigid.

* * * * *